US009927214B2

(12) United States Patent
Côté et al.

(10) Patent No.: US 9,927,214 B2
(45) Date of Patent: Mar. 27, 2018

(54) TARGET ATTACHMENT SYSTEM SECONDARY TARGET ATTACHMENT DEVICE AND METHOD OF USING THE SAME

(71) Applicant: 9091-4532 QUEBEC INC., L'Isle-Verte (CA)

(72) Inventors: Etienne Côté, L'Isle-Verte (CA); Alexandre Côté, L'Isle-Verte (CA)

( * ) Notice: Subject to any disclaimer, the term of this patent is extended or adjusted under 35 U.S.C. 154(b) by 0 days.

(21) Appl. No.: 15/062,921

(22) Filed: Mar. 7, 2016

(65) Prior Publication Data

US 2016/0258720 A1 Sep. 8, 2016

Related U.S. Application Data

(60) Provisional application No. 62/128,599, filed on Mar. 5, 2015.

(51) Int. Cl.

| | |
|---|---|
| ***F41J 1/10*** | (2006.01) |
| ***F41J 5/18*** | (2006.01) |
| ***F41J 7/04*** | (2006.01) |
| *F41J 1/00* | (2006.01) |

(52) U.S. Cl.
CPC . *F41J 1/10* (2013.01); *F41J 5/18* (2013.01); *F41J 7/04* (2013.01); *F41J 1/00* (2013.01)

(58) Field of Classification Search
CPC ..... F41J 1/00; F41J 1/10
USPC ..... 273/403–408
See application file for complete search history.

(56) References Cited

U.S. PATENT DOCUMENTS

| | | | | |
|---|---|---|---|---|
| 1,103,579 | A * | 7/1914 | Hall | F41J 1/10 248/304 |
| 6,398,215 | B1 * | 6/2002 | Carroll | F41J 1/10 273/108 |
| 6,776,418 | B1 * | 8/2004 | Sovine | F41J 1/10 273/407 |
| 7,690,656 | B2 * | 4/2010 | Saunders | F41J 3/0004 273/392 |
| 8,684,361 | B2 | 4/2014 | Henson et al. | |
| 9,631,906 | B2 * | 4/2017 | English | F41J 5/052 |
| 2004/0239035 | A1 * | 12/2004 | Lambert | F41J 7/04 273/348 |
| 2005/0001381 | A1 * | 1/2005 | Lambert | F41J 7/04 273/348 |
| 2009/0256314 | A1 * | 10/2009 | Kobett | F41J 1/10 273/407 |

(Continued)

*Primary Examiner* — Mark Graham
(74) *Attorney, Agent, or Firm* — Benoit & Cote, Inc.; C. Marc Benoit

(57) ABSTRACT

There is provided a target attachment system for attaching a target having an opening therethrough. The target attachment system comprises a support comprising a holding member and a releasable target attachment element. The releasable target attachment element comprises an elongated engagement member and an abutment surface. The elongated engagement member is adapted to be inserted through the target opening and to be releasably fixed to the holding member. The abutment surface is adapted to abut the target towards the support once the engagement member is releasably fixed to the holding member. The proposed system does not have exposed mounting brackets or exposed bolts that may redirect bullet splatter in all directions which is dangerous.

20 Claims, 13 Drawing Sheets

(56) References Cited

U.S. PATENT DOCUMENTS

| | | | | |
|---|---|---|---|---|
| 2010/0225063 | A1* | 9/2010 | Wyrick | F41J 1/10 273/390 |
| 2013/0001880 | A1* | 1/2013 | Dean | F41J 1/10 273/407 |
| 2013/0106059 | A1* | 5/2013 | Larue | F41J 1/10 273/407 |
| 2013/0328268 | A1 | 12/2013 | Eggiman et al. | |
| 2014/0284879 | A1* | 9/2014 | Hendrix | F41J 1/10 273/407 |
| 2014/0300055 | A1* | 10/2014 | Papp | F41J 1/10 273/407 |
| 2015/0260486 | A1* | 9/2015 | Trimbath | F41J 7/04 273/407 |
| 2015/0268013 | A1* | 9/2015 | Heise | F41J 7/04 273/389 |
| 2017/0184378 | A1* | 6/2017 | Fernandez | F41J 7/04 |

* cited by examiner

TARGET ATTACHMENT SYSTEM SECONDARY TARGET ATTACHMENT DEVICE AND METHOD OF USING THE SAME

CROSS-REFERENCE TO RELATED APPLICATION

This application claims priority from U.S. patent application 62/128,599 filed Mar. 5, 2015, the specification of which is hereby incorporated herein by reference in its entirety.

BACKGROUND (a) Field

The subject matter disclosed generally relates to target attachment systems, to secondary target attachment devices and to methods of using the same. More particularly, the subject matter relates to head-mounted target attachment systems and to methods of using the same.

(b) Related Prior Art

Steel targets are targets for firearms made out of hardened (i.e., martensitic) steel, and are used in sports, practical/dynamic shooting and for long range shooting. They are popular in both training and competition as the shooter gets immediate feedback on whether it's a hot or a miss in the form of sound, and one can also often see the bullet getting pulverized and the target moving. A common trademark in the USA for hardened steel used in the production of targets is AR500.

There currently exists on the market a plurality of target attachment systems for receiving a steel target and to be installed at a particular distance from the shooter. However, these known target attachment systems have some drawbacks.

For example, some target attachment systems may include mounting brackets and/or exposed bolts that are sometimes in the shooting direction and that can redirect bullet splatters towards the shooter at a dangerous velocity. US Publication 2013/0328268 from Eggiman et al. describes such a system wherein a shield is necessary to be place in front of the attachment to hide the brackets.

Moreover, some target attachment systems require that the steel target requires a welded design. U.S. Pat. No. 8,684,361 B2 describes a target attachment system with hinge mounts welded on the back of the target. Such a welded design may expose the steel target to heat variations from the welding process and may alter the structural integrity of the steel target. Such decrease in the integrity of the steel target may lead the steel target to be softer and more prone to holes and cracks creation that could cause dangerous unpredictable bullet splatter patterns.

Additionally, almost all target attachment systems require important storage areas for storing the targets and the target attachments system separately.

Also, even if shooters know that allowing for quick turnovers of a range and less down time can be the difference between a successful event and a long day at the range, modifying the target attachment system in different configurations to practice different skills is still a challenge that can be hard, long and require equipment and sophisticated tools.

There is therefore a need for improved target attachment systems, improved secondary target attachment devices and improved methods of using the same.

SUMMARY

According to an embodiment, there is provided there is a target attachment system for releasably attaching a target having an opening therethrough. The target attachment system comprises a support comprising a holding member and a releasable target attachment element comprising an elongated engagement member and an abutment surface. The elongated engagement member is adapted to be inserted through the target opening and to be releasably fixed to the holding member. The abutment surface is adapted to abut the target towards the support once the elongated engagement member is releasably fixed to the holding member.

According to an aspect, the releasable target attachment element further comprises a ricochet surface downwardly sloped with respect to the abutment surface, thereby adapted to ricochet bullets toward the ground.

According to another aspect, the abutment surface has a cross-section greater than the target opening and is adapted to abut the target about the opening.

According to another aspect, the elongated engagement member has a first end about the abutment surface and a second end adapted to be releasably fixed to the holding member, wherein the elongated engagement member has a curvature between the first end and the second end.

According to another aspect, the support comprises a back abutment surface, and the target has a front face and a back face, with the abutment surface of target attachment element and the back abutment surface each abutting one of the front face and the back face of the target when the target is attached to the target attachment system.

According to an aspect, the back abutment surface defines a front-leaning angle resulting in bullets shot to the target abutting the back abutment surface and ricocheting towards the ground.

According to an aspect, the support comprises a base, a lower post member and an upper post member comprising the holding member, with the base, the lower post member and the upper post member combining together as a foldable structure.

According to an aspect, the support further comprises a pivotal target holding component comprising a first ring-shaped frame and a second open ring-shaped frame defining a passageway, and a pivotal component adapted to close the passageway once a secondary target is inserted in the first frame and the second frame.

According to an aspect, the support defines a front face close to the target and a back face opposed to the target, with the pivotal target holding component being mounted on the back face of the support.

According to an aspect, the elongated attachment member has a defined cross-section shape and the holding member forms a hollow passage of the defined cross-section shape. The elongated attachment member is for inserting in the hollow passage thereby releasably fixing the releasable target element to the holding member and hence releasably fixing the target to the support.

According to an aspect, the upper post member comprises two elongated and parallel projections and the holding member comprises a first and second retaining members. The hollow passage is defined by the two elongated and parallel projections and the first and second retaining members. The two elongated and parallel projections define two interior surfaces of the hollow passage while the first and second retaining members define two other interior surfaces of the hollow passage.

According to an aspect, the elongated attachment member comprises an inverted U-shape member and holding member comprises a lip member adapted to receive the inverted U-shaped member and thereby releasably fixing the releasable target element to the holding member and hence releasably fixing the target to the support.

According to an embodiment, there is a target attachment element for releasably attaching a target having an opening therethrough to a holding member part of a support that is adapted to support the target. The target attachment element comprises an elongated engagement member adapted to be inserted in the target opening and to be releasably attached to the holding member, a supporting surface applying a force to the target against a gravitational force when the elongated engagement member is inserted into the opening and an abutment surface abutting the target toward the support.

According to an aspect, the target attachment element further comprises a ricochet surface downwardly sloped with respect to the abutment surface, thereby adapted to ricochet bullets toward the ground.

According to an aspect, the elongated engagement member has a first end about the abutment surface and a second end adapted to be releasably fixed to the holding member, wherein the elongated engagement member has a curvature between the first end and the second end.

According to an aspect, the elongated engagement member has a first end about the abutment surface and a second end adapted to be releasably fixed to the holding member, and wherein the second end has a defined cross-section shape and the holding member forms a hollow space of the defined cross-section shape.

According to an aspect, the defined cross-section shape is one of a square and a rectangular shape.

According to an embodiment, there is a target assembly comprising a target attachment system, a primary target and a secondary target. The target attachment system comprises a support comprising a static target holding member and a pivotal target holding member comprising a first frame and a second frame aligned with the first frame. The secondary target defines a secondary target body and a projection portion comprising a first projection end and a second projection end. The secondary target is adapted to be attached to the pivotal target holding member with the first projection end attached to the first frame and the second projection end attached to the second frame as to have the secondary target body being mounted in a pivotal manner on the support, thereby having the secondary target able to take a first hit position and a second hit position.

According to an aspect, the support defines a front face close to the primary target and a back face opposed to the primary target, and wherein the pivotal target holding member is mounted on the back face of the support.

According to an aspect, the support further comprises a pivotal target holding component comprising a first ring-shaped frame and a second open ring-shaped frame defining a passageway, and a pivotal component adapted to close the passageway once a secondary target is inserted in the first frame and the second frame.

According to an embodiment, there is a method of setting up a target foldable support comprising a base, a lower post member, an upper post member and target attachment element. The method comprises: (1) placing the target foldable support on the ground with the base engaging with the ground; (2) pivoting the combination of the lower post member and the upper post member upwardly about the base in a lower post member unfolded position; (3) securing the lower post member in the lower post member unfolded position; (4) pivoting the upper post member upwardly about the lower post member in an upper post member unfolded position; (5) securing the upper post member in the upper post member unfold position; (6) inserting an engagement member of the target attachment element into an opening of a target; and (7) inserting the engagement member in a holding member part of the upper post member thereby releasably fixing the target to the upper post member. Accordingly, a rapid set up of the components necessary to perform target practice is available.

According to another embodiment, there is a method of setting down a target foldable support comprising a base, a lower post member, an upper post member and target attachment element in a storing condition. The method comprises: (1) releasing the upper post member from a pivot-disabled condition about the lower post member; (2) pivoting the upper post member downwardly about the lower post member in an upper post member folded position; (3) releasing the lower post member from a pivotal-disabled condition about the base; and (4) pivoting the combination of lower post member and upper post member downwardly about the base in a lower post member folded position. Accordingly, a rapid set down of the components used when performing target practice is available.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In embodiments there are disclosed target attachment systems, secondary target attachment devices and methods of using the same.

Figure 1:
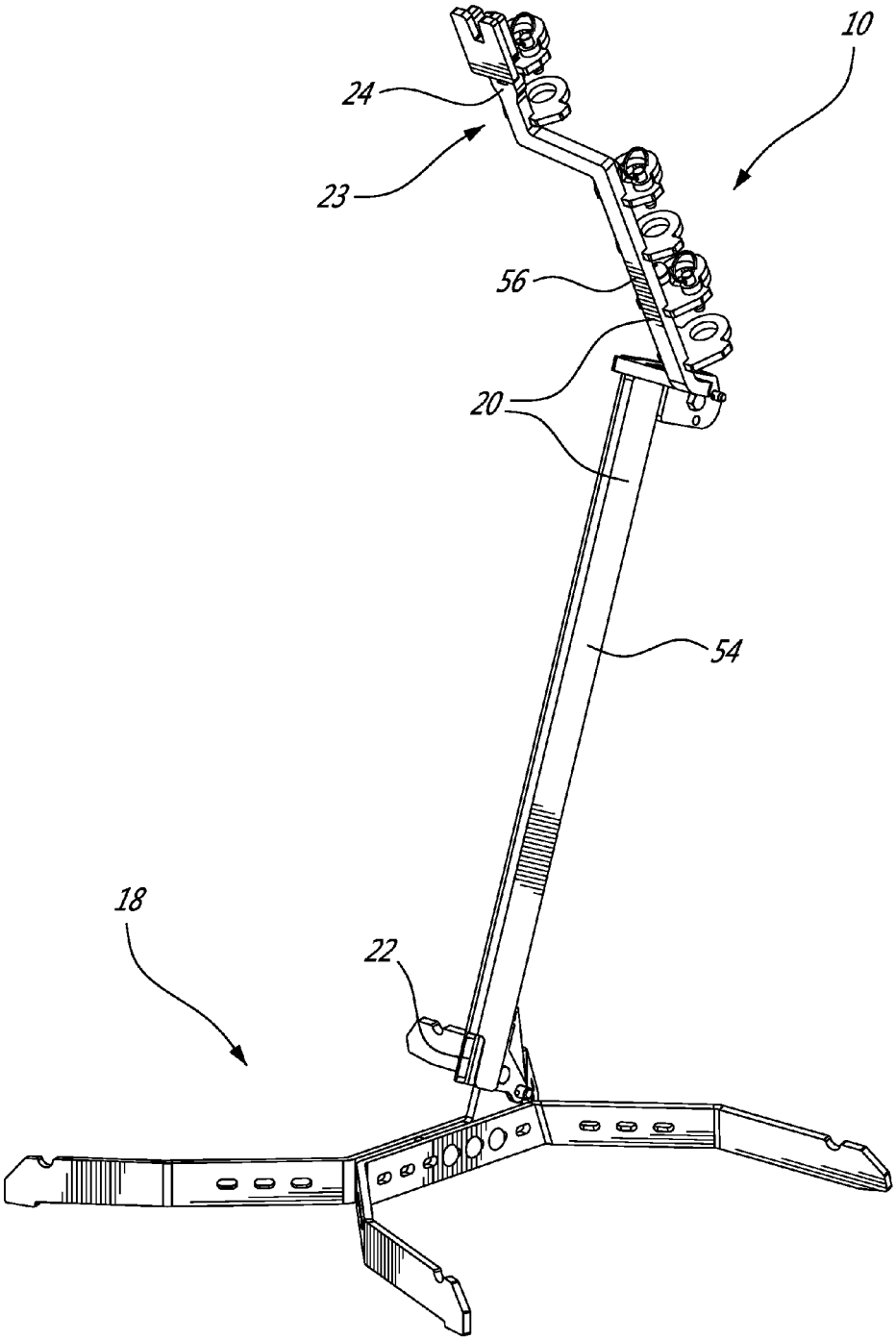
FIG. 1 is a front perspective view of a target attachment system in accordance with an embodiment.
Figure 2:
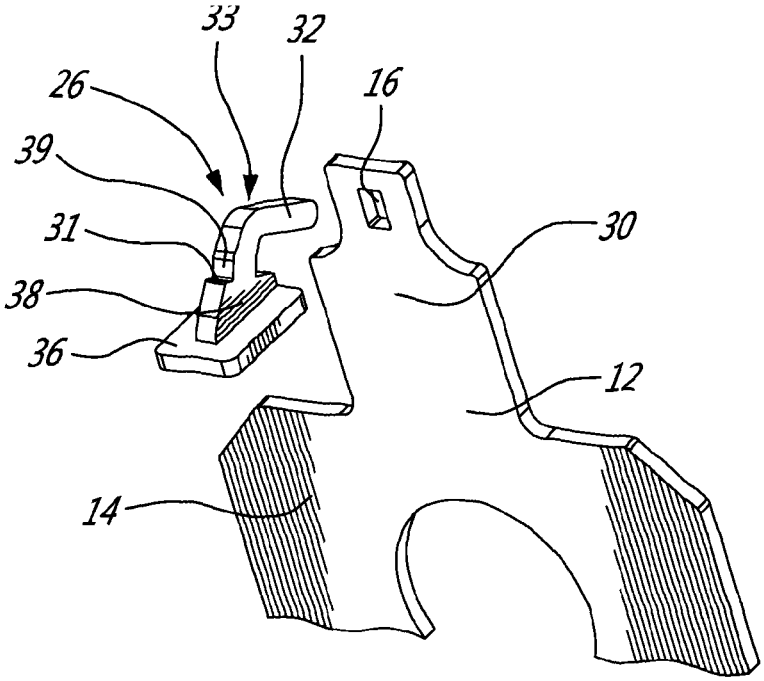
FIG. 2 is a partial front perspective view of a target and part of the target attachment system shown FIG. 1.

Referring now to the drawings, and more particularly to FIGS. 1-5, there is shown a target attachment system 10 which is configured to receive a target 12, such as a metallic target. As best shown in FIG. 2, the target 12 includes a target body 14 and an opening 16 therethrough. The target body 14 defines a front face 30, a back face 34, and walls defined by the opening 16 defined in the target body 14. The target attachment system 10 features a base 18 and a post 20 which upwardly extends from the base 18. The post 20 defines a base end 22 and a holding end 24 (acting as a support 23 as explained later) opposite the base end 22. The target attachment system 10 further includes a target attachment element 26 which is configured to have an engagement member 32 inserted into the opening 16 of the target body 14 to be releasably fixed to the support 23 (through the holding end 24) therefore attaching the target 12 to the target attachment system 10. The engagement member 32 defines an elongated structure having a first end close to an abutment surface 31 and a second end opposed to the abutment member adapted to the holding end 24, and a holding surface 39 supporting the target 12 when the target attachment system holds a target 12. The holding surface 39 supports the target 12 by applying a force to the target 12 against (i.e., having at least a component in a direction opposite to) the gravitational force.

As best shown in FIG. 2, the target attachment element 26 includes an abutment surface 31 which will interface and/or interact with an external surface 30 (the front face) of the target body 14 about the opening 16. The target attachment element 26 further includes a substantially elongated engagement member 32 extending from the abutment surface 31 and adapted to fit into and be inserted in the opening 16 defined by the target body 14. The substantially elongated engagement member 32 features an angle curvature so that when inserted into the opening 16 such that having the abutment surface 31 in contact against the front face 30 of the target body 14 about the opening 16, the portion of the engagement member 32 located at the extremity opposed to the abutment surface 31 of the substantially elongated engagement member 32 will be substantially parallel to (or follow) the internal surface 34 (the back face) of the target body 14.

Figure 3:
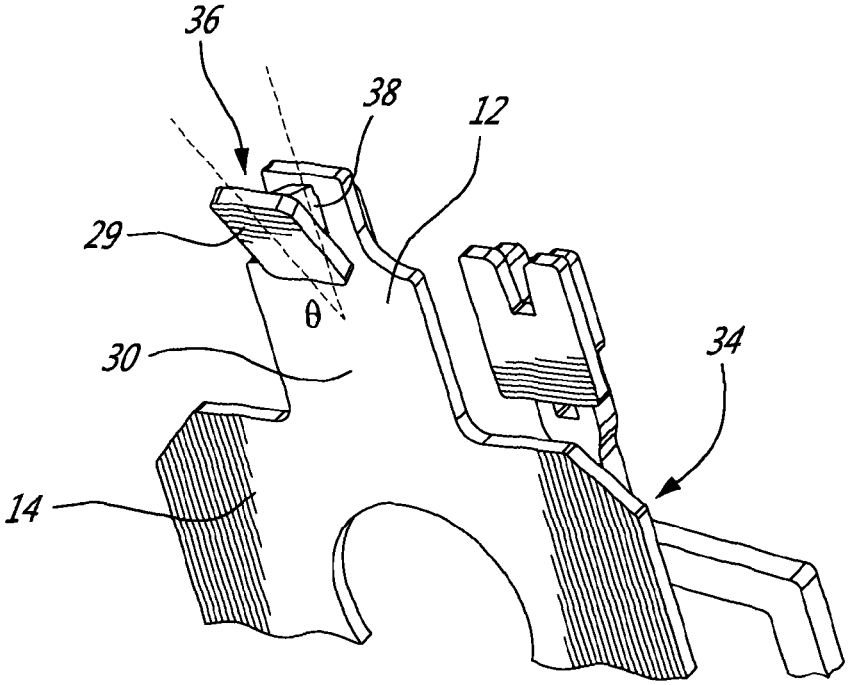
FIG. 3 is a partial close-up view of the target and part of the target attachment system shown in FIG. 2, where the part of the target attachment system is introduced in the opening defined in the target.
Figure 4:
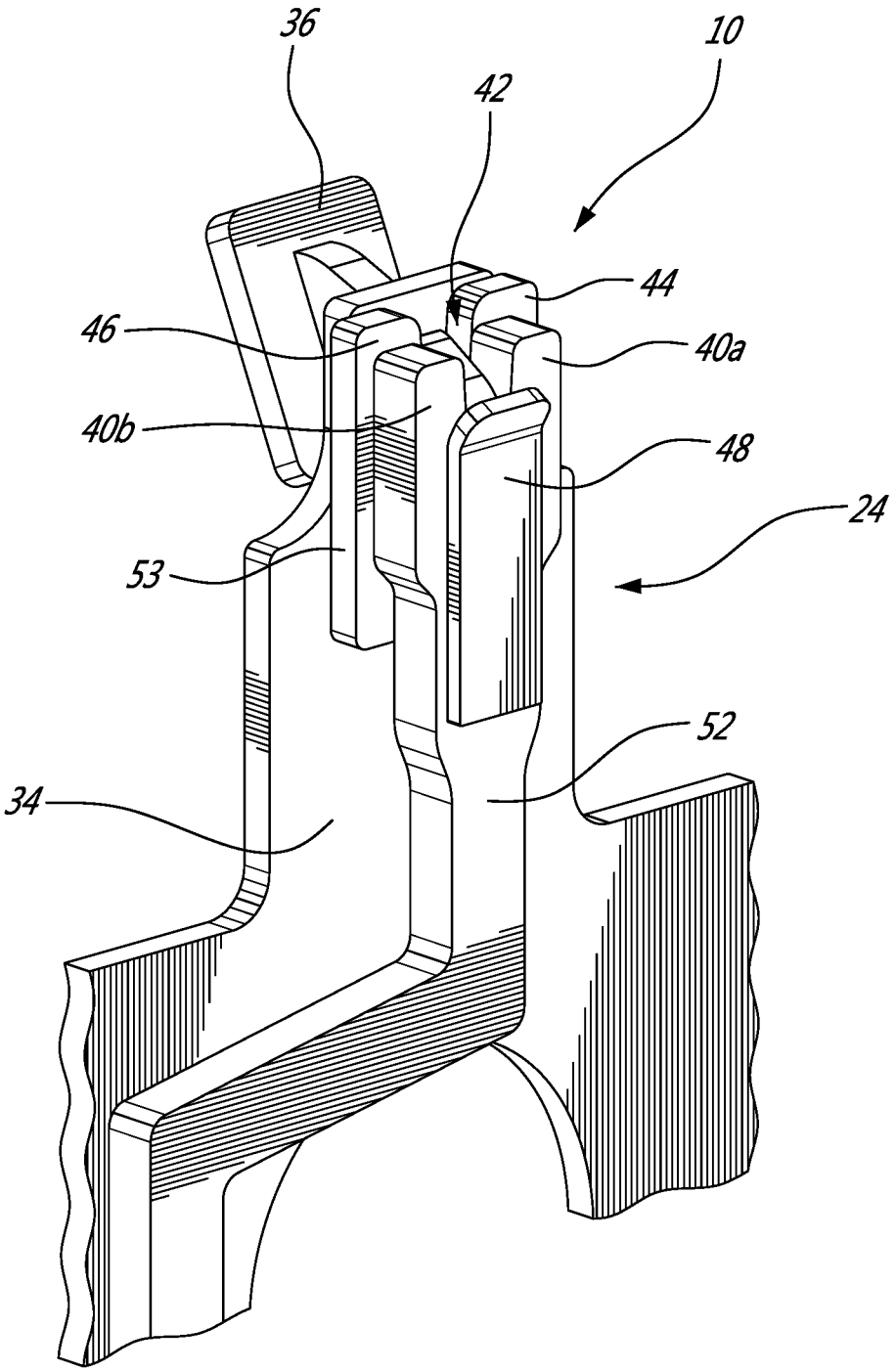
FIG. 4 is a partial rear perspective view of the target shown in FIGS. 2-3 attached to the target attachment system shown in FIGS. 2-3.
Figure 5:
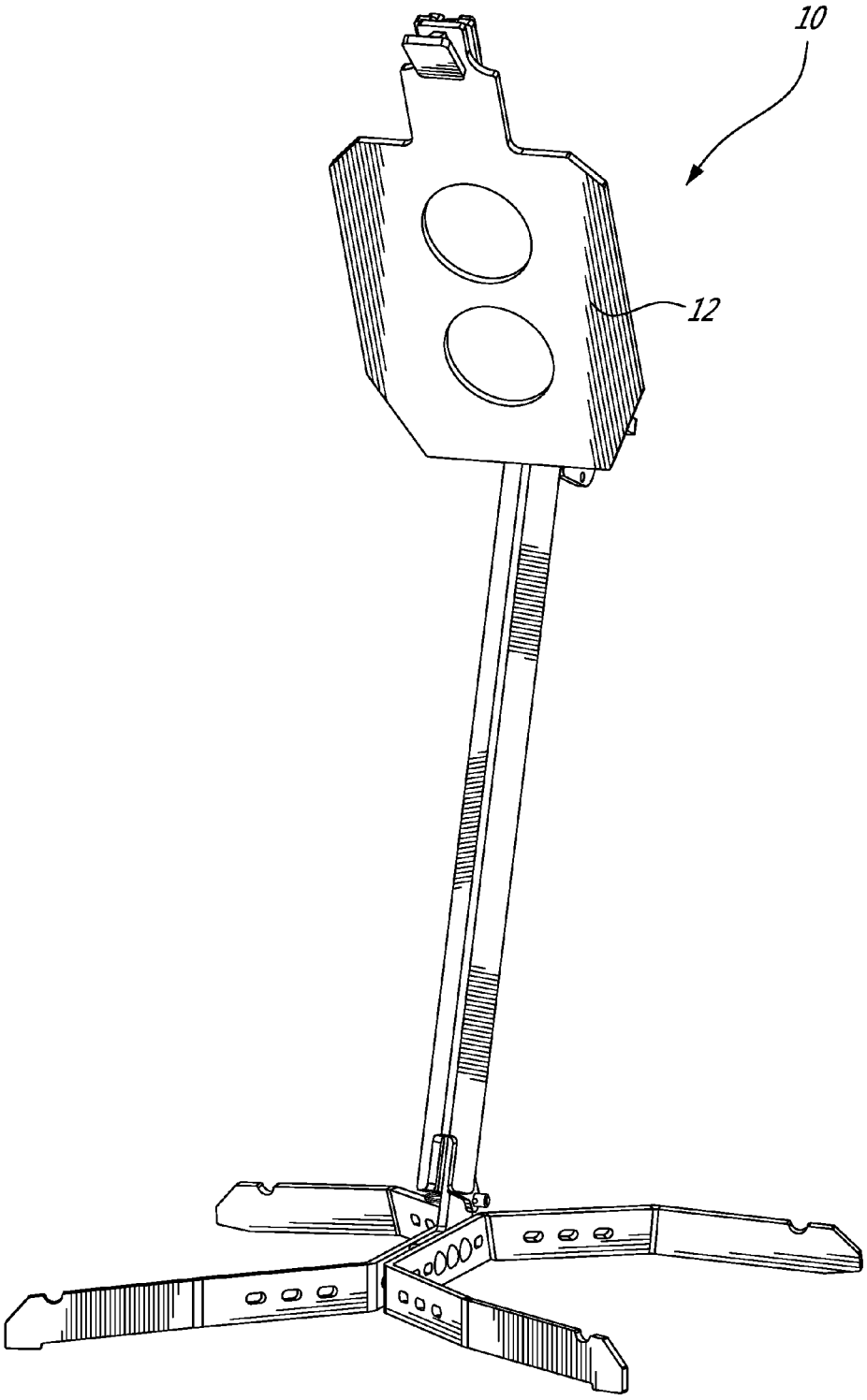
FIG. 5 is a front perspective view of the target shown in FIGS. 2-3 attached to the target attachment system shown in FIGS. 2-3.
Figure 6:
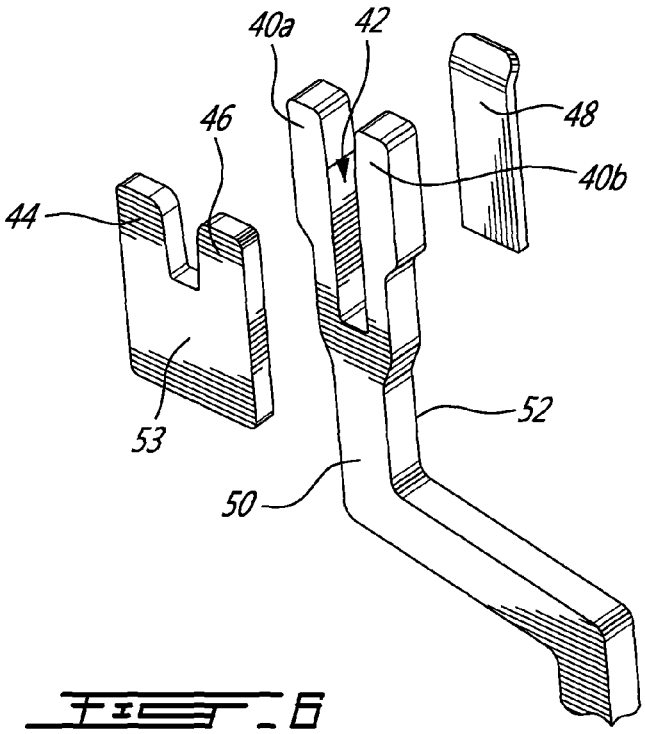
FIG. 6 is a partial exploded view of a part of the target attachment system of FIG. 1.
Figure 16:
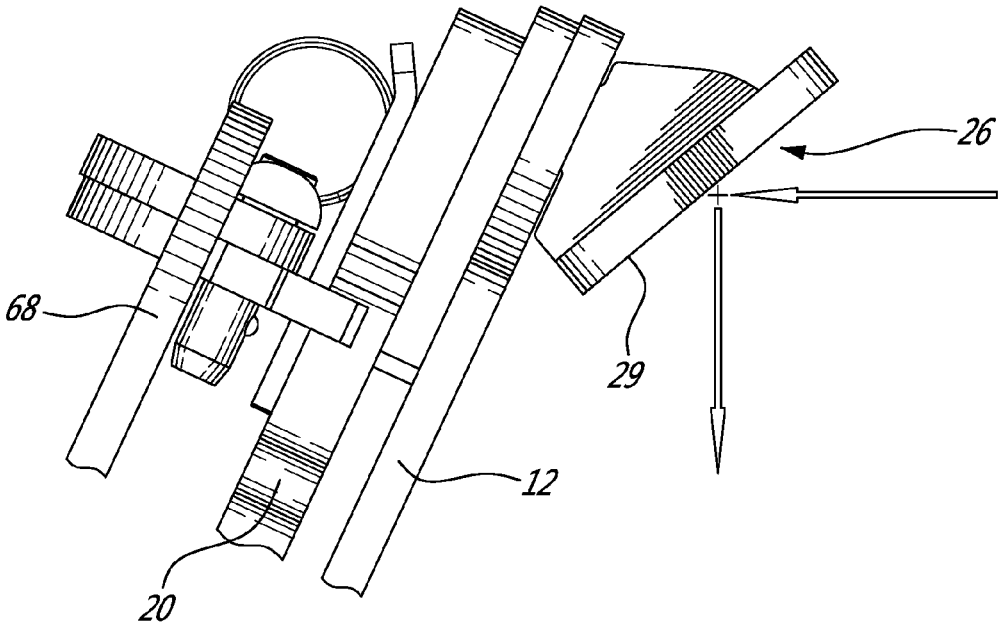
FIG. 16 is a partial side elevation view of a target attachment system in accordance with another embodiment.
Figure 17:
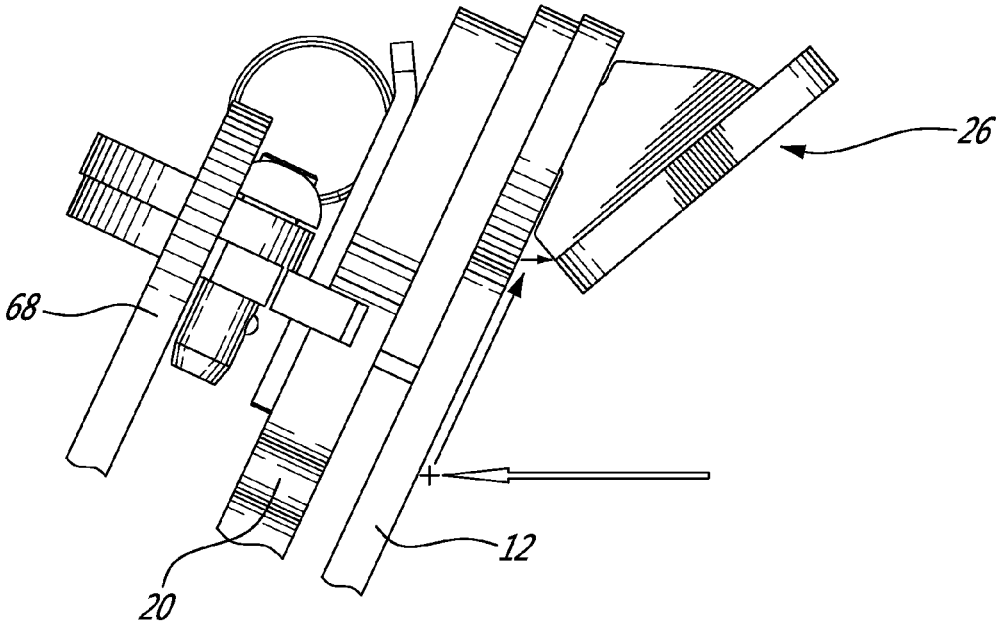
FIG. 17 is a partial side elevation view of a target attachment system in accordance with another embodiment.

On its opposite end, the target attachment element 26 includes a flat member 36 and an angular member 38 (see also FIGS. 3 and 4). According to this configuration, when the engagement member 32 is inserted into the opening 16 defined by the target body 14, the angular member 38 will act as an abutment and will be the one interfacing or cooperating with the external surface 30 of the target body 14 according to the abutment surface 31. The angular member 38 will then provide an angle θ (see FIG. 3) between the planes defined by the surface of the flat member 36 and by the internal surface 34 of the target body 14. As a result, when a shooter hits the target attachment element 26 (more specifically the visible surface of the flat member 36 of the target attachment element 26, which is the only visible portion of the target holding components of the target attachment system 10 from the shooter's point of view) instead of the target 12 itself, the bullet, or the bullet splatters will not be redirected towards the shooter's position, but towards the ground (because of that angle θ) (see FIG. 16). Furthermore, according to the configuration of the target attachment element 26 interacting with the target 12 forcing the target body in a sloped position in which the top of the target body 14 is closer to the shooter than the bottom of the target body 14, when a bullet hits the target 12, the bullet splatters or the bullet itself will not be redirected towards the shooter's position as the bullet splatters or ricochet but rather be projected towards the ground or be stopped by the target attachment element 26 between the target 12, the angular member 38 (i.e., the ricochet surface 29) and the flat member 36 (see FIG. 17).

As shown in FIGS. 2-5, the substantially elongated engagement member 32 of the target attachment element 26 defines a cross-sectional area which is substantially equivalent to (or slightly smaller than) the cross-sectional area defined by the opening 16 of the target body 14.

Now referring to FIGS. 3-6, the target attachment element 26 is configured, once the engagement member inserted into the opening 16 defined by the target body 14, to be releasably fixed to the holding end 24 of the post 20. Indeed, the holding end 24, acting as a holding member, features two elongated and parallel projections 40*a*, 40*b* upwardly extending from the post 20, which together with first and second retaining members 53, 48 define a hollow passage 42 for receiving the substantially elongated engagement member 32 (see FIG. 2) of the target attachment element 26. The width of the substantially elongated engagement member 32 of the target attachment element 26 is substantially equivalent to the width of (but smaller than) the hollow passage 42 defined by the two elongated and parallel projections 40*a*, 40*b*.

To perform the holding function and thereby allow the releasable attachment of the target 12 to the post 20, the holding end 24 further features a first retaining member 53 and a second retaining member 48. They define, in cooperation with the two elongated and parallel projections 40*a*, 40*b*, a square-shaped cross-section hollow passage 42 (while an alternative embodiment may feature a rectangular-shaped cross section allow passage 42). The first retaining member 53 features elongated and parallel projections 44, 46. The first retaining member 53 is mounted on a first side 50 of the post 20 to interface and/or cooperate with the internal surface 34 of the target body 14. The parallel projections 44, 46 are parallel to one another and also parallel to the two elongated and parallel projections 40*a*, 40*b*. The second retaining member 48 is mounted on a second side 52 of the post 20 (i.e., opposite to the first side 50 of the post 20). The first and second retaining members 53, 48 may be directly welded to the post 20 or may be mounted on the post 20 using well know techniques using suitable fasteners (i.e., screws, nuts, bolts, and the like).

According to the configuration of the target attachment system 10 described above, the target 12 is therefore head-mounted front-leaning on the target attachment system 10, abutting a back abutment surface defined by the first retaining member 53, so as to direct safely most of the bullet splatters downward without risking putting a mounting bracket in a position where it could potentially redirect bullets toward the shooter at dangerous velocity. These advantages are obtained by having the visible surface of the mounting bracket, a ricochet surface 29, kept to a minimum on the external surface 30 of the target body 14 and by having the ricochet surface 29 and the target body 14 front-leaning to redirect the bullets downwardly.

Furthermore, the present configuration of the target attachment system 10 provides a non-welded target 12, since the attachment provided by the target attachment element 26 is a discrete component distinct from the target 12. Rather than welding mounting brackets to the internal surface 34 of the target body 14, the present solution makes use of a releasable fixation mechanism featuring on the pole-side the two elongated and parallel projections 40*a*, 40*b*, and the first and second retaining members 53, 48, which are hidden behind the target 12 itself, that are in combination adapted to releasably receive the target attachment element 26. Thus, the target body 14 itself is not exposed to any heat process from a welding process that would alter the structural integrity of the target 12 or metallic target 12. Furthermore, by keeping its flat character and requiring no transformation process, the target 12 is more economical to produce and more storage friendly.

One will note that, when the end of the engagement member 32 is inserted in the hollow space, the engagement member becomes releasably engaged with the holding end 24. Upon lifting the target 14 and pulling the target attachment element 26 forward, the end of the engagement member 32 is released from the hollow space, thereby detaching the target 12 from the post 20.

Figure 8:
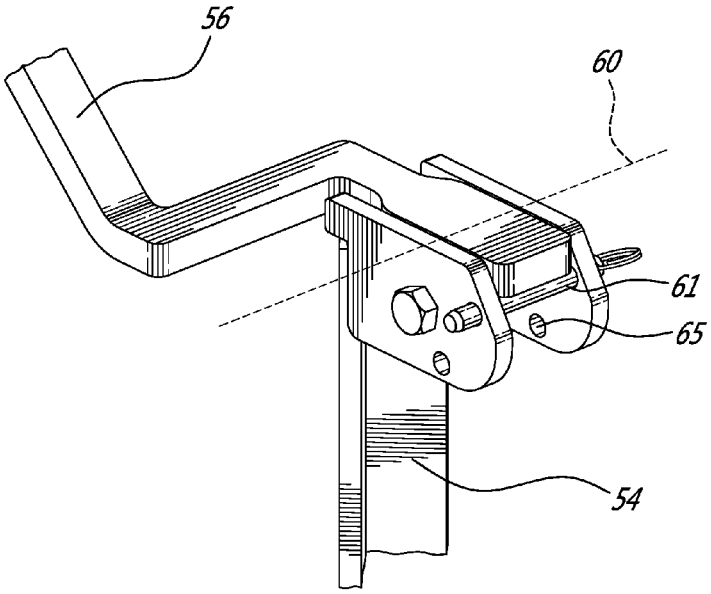
FIG. 8 is another partial close-up view of a part of the post of the target attachment system of FIG. 1.
Figure 9:
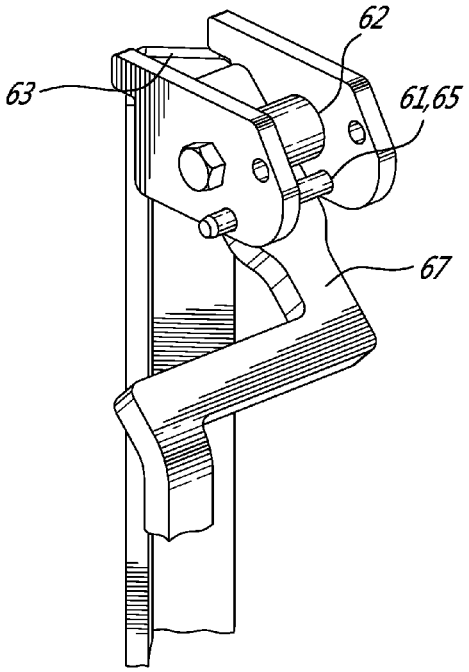
FIG. 9 is a partial close-up view of a part of the post of the target attachment system of FIG. 1, where the post is shown in the partially retracted position.
Figure 10:
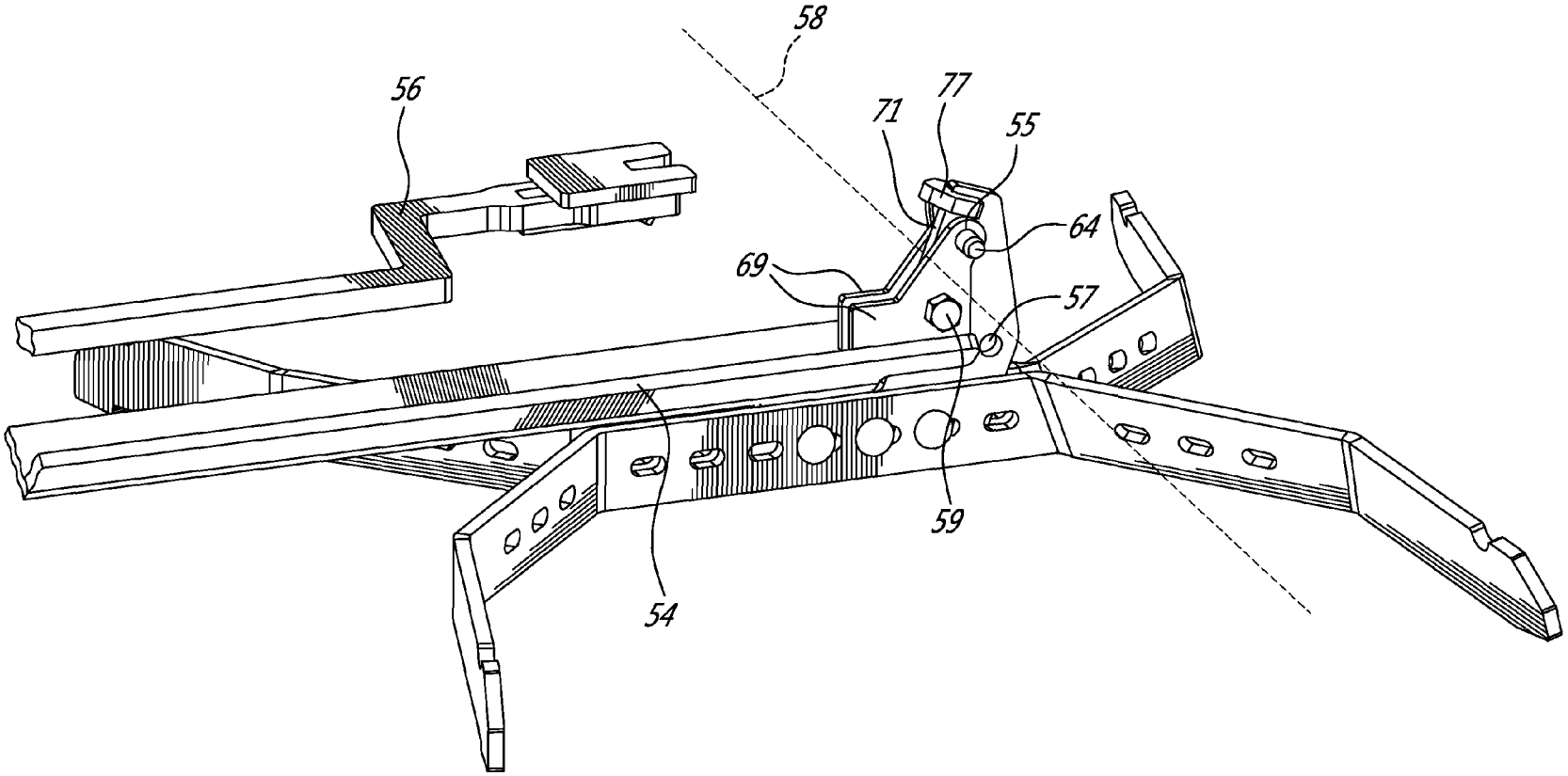
FIG. 10 is a partial close-up view of a part of the post of the target attachment system, where the post is shown in a completely retracted position.
Figure 11:
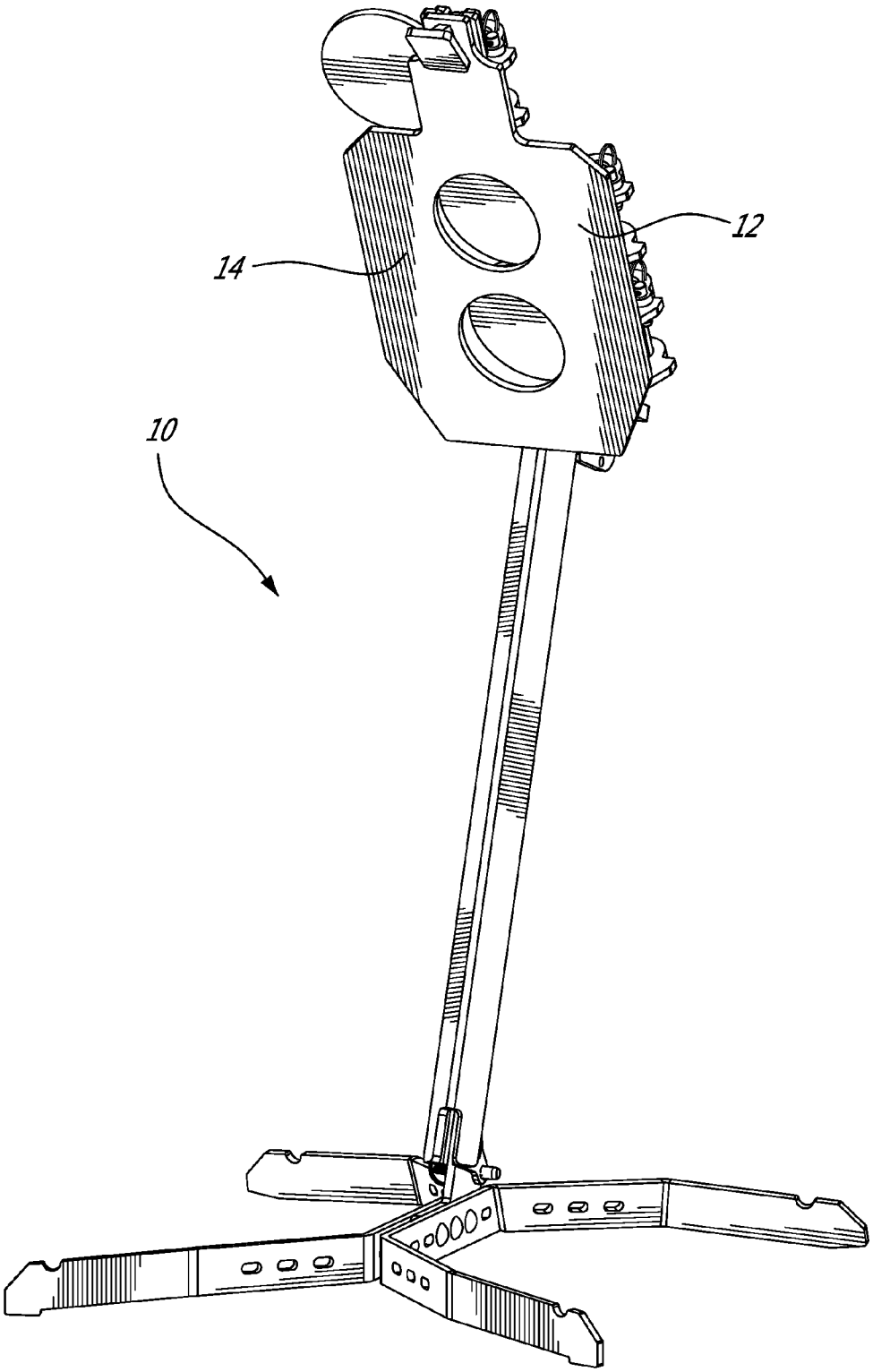
FIG. 11 is a perspective view of a target attached to a target attachment system in accordance with another embodiment, where the target attachment system is further adapted to receive a plurality of secondary targets.

According to another embodiment and referring now to FIGS. 1 and 7-10, there is shown that the target attachment system 10 is configured to be capable of displacement between a self-standing position (FIGS. 1 and 8), a partially retracted, or partially folded, position (FIG. 9) and a completely retracted, or folded, position (FIG. 10).

Figure 7:
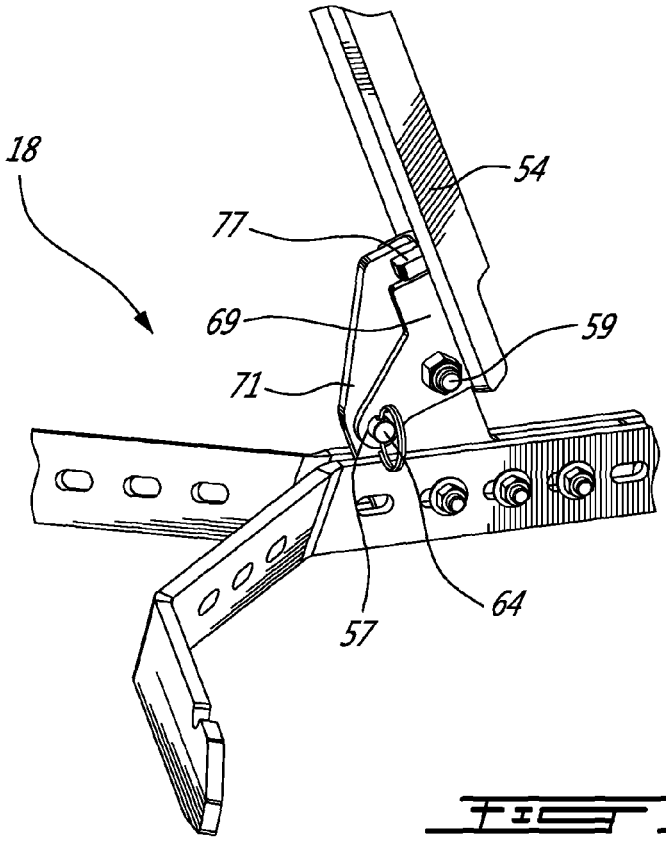
FIG. 7 is another partial close-up view of the base of the target attachment system of FIG. 1.

As better shown in FIGS. 1, 7 and 10, the post 20 includes a lower post member 54 and an upper post member 56. The lower post member 54 that extends from the base 18 and is pivotally mounted on it. The upper post member 56 extends from the lower post member 54 and is pivotally mounted on it. Thus, the lower post member 54 is capable of pivoting relative to the base 18 around a lower pivot axis 58 and the upper post member 56 is capable of pivoting relative to the lower post member 54 around an upper pivot axis 60. FIG. 1 shows the target attachment system 10 is in its self-standing position. FIG. 9 shows the target attachment system 10 with the upper post member 56 pivoted relative to the lower post member 54 about the upper pivot axis 60, bringing the target attachment system 10 in a partially retracted position. As illustrated more specifically through FIGS. 8-9, the upper post member 56, when in an erected position (FIG. 8) has a contact surface 67 abutting the end surface 63 of the lower post member 54. The fastening bolt 62 pivotally holds the upper post member 56 with respect to the lower post member 54. The pin 61 provides an abutment, upon a jolt resulting from a bullet hitting the target 12, preventing the upper post member 56 from pivoting backwardly. When in partially retracted position (FIG. 9), obtained once the pin 61 is removed and the upper post member 56 has pivoted backward, the upper post member may be blocked in that partially retracted position by inserting the pin 61 in the hole 65.

The pivotal mechanism coupling the lower post member 54 to the base 18 comprises a pair of post connection plates 69 mounted to the lower post member 54. The post connection plates 69 are disposed on both sides and pivotally connected to a base connection plate 71 using a bolt 59. The lower post member rotates about the bolt 59, with a pin 64 locking the upper post member 54 in an erected position or a folded position based on in which of the holes 55,57 the pin 64 is inserted in. To complete, an abutment part 77 having a substantially triangular shape helps stabilizing the lower post member 54 when in an erected position. To modify the configuration of the lower post member 54, one simply pulls out the pin 64, rotates the lower post member 54 to the desired position, and places the pin 64 in the appropriate hole 55 or 57.

FIG. 10 shows the target attachment system 10 with the lower post member 54 pivoted relative to the base 18 about the lower pivot axis 58, bringing the target attachment system 10 in a completely retracted position. It is to be mentioned that the lower post member 54 may be made of a 44w steel, of an AR500 steel (which is more durable) or of any suitable material.

Because the upper post member 56 is capable of pivoting relative to the lower post member 54 and because the lower post member 54 is capable of pivoting relative to the base 18, the structure (i.e., the post 20) can adopt a plurality of different configurations depending on the requirements provided by the shooter. Angles between the upper post member 56 and the lower post member 54, and between the lower post member 54 and the base 18 are adjustable by the user to obtain the desired configuration.

As better shown in FIG. 7, the lower post member 54 is pivotally connected to the base 18 using pin 64 so that it is an easy and short process for the shooter to set up the target attachment system 10 in the usable configuration.

As better shown in FIGS. 7, 8 and 9, the upper post member 56 is pivotally connected to the lower post member 54 using pins 61, 64 so that it is an easy and short process for the shooter to set up the target attachment system 10 in the usable configuration.

According to the configuration of the target attachment system 10 capable of adopting self-standing, partially retracted and completely retracted positions, the shooter may have a lot of flexibility using his target attachment system 10. The target attachment system 10 is therefore completely foldable to form a foldable structure that uses less space when stored as to ease movement for crowded or indoor ranges. Furthermore, with target sizes, the target attachment system 10 may also be brought to its partially and/or completely folded/unfolded positions with the target (s) 12 still attached to it so that it reduces setup time for the shooter at the start and the end of the shooting sessions.

The configuration of the target attachment system 10 features the advantages of allowing the shooter to change from one target 12 to a completely different setup of targets 12 without using any tool while keeping the same base 18 or the same target attachment system 10 in less than one minute. By allowing for quick turnovers of a range decreasing down time, the target attachment system 10 can make the difference between a successful and unsuccessful event at a shooting range.

Referring now to FIGS. 11-15, there is shown another embodiment of a target attachment system 66. The target attachment system 66 allows a shooter to use one or more pivotal secondary target(s) 68 in addition to the fixed target 12 to increase the ability level or to practice different skills. The target attachment system 66 is therefore adapted for receiving secondary target(s) 68 as either mounted on or part of the post 20.

Figure 12:
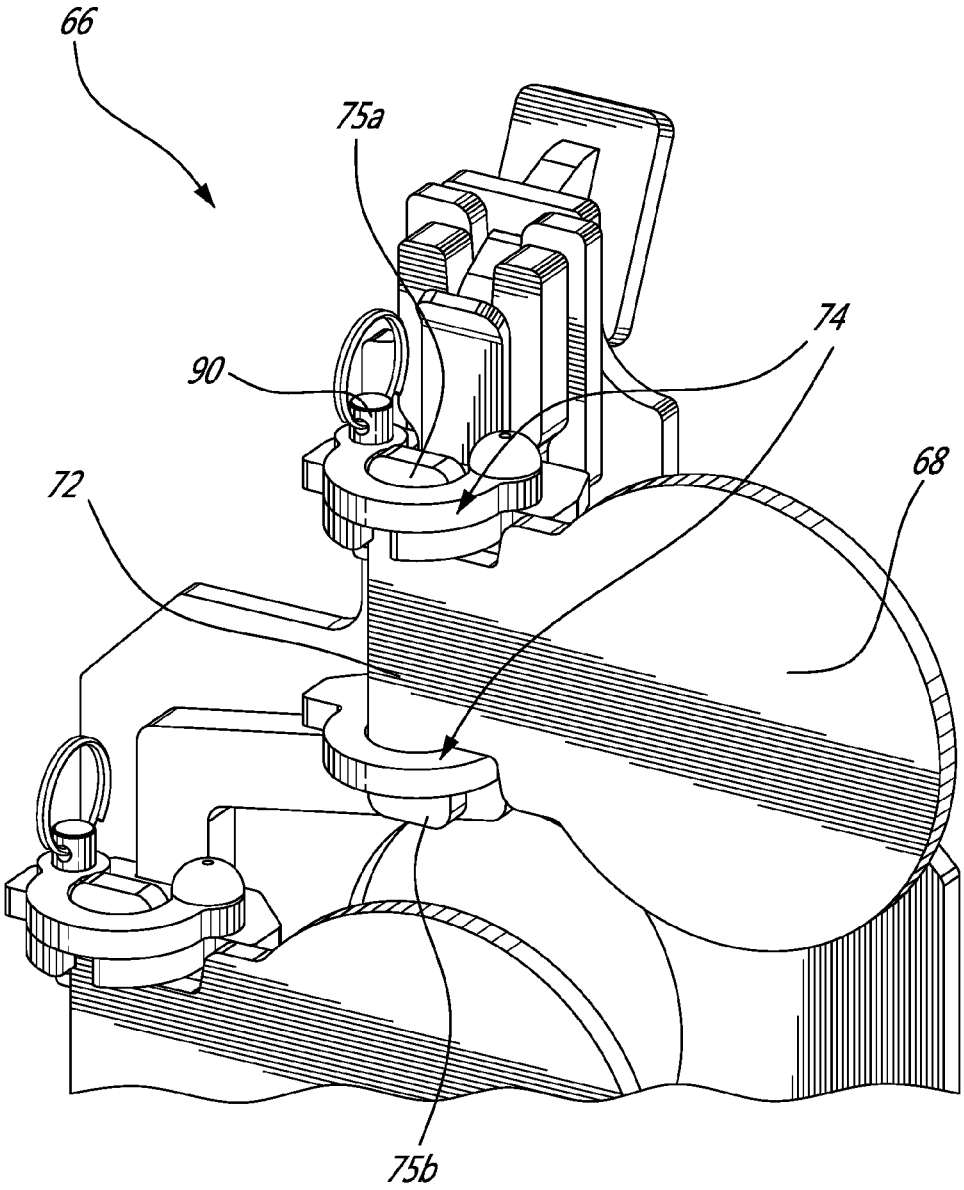
FIG. 12 is a partial close-up view of the secondary target attachment device in accordance with another embodiment.

As shown in FIG. 12, each secondary target 68 includes a secondary target body 70 and a projection 72 which extends from the secondary target body 70. It is the projection 72 that interacts/cooperates and is releasably attached with the target attachment system 66. The target attachment system 66 includes a secondary target holding frame 73 which is adapted to be mounted on the post 20. The secondary target attachment system 66 further includes a retainer portion 74 extending from the secondary target holding frame 73. The retainer portion 74 defines a passage 76 for receiving the projection 72 of the secondary target 68. The projection 72 comprises a first projection end 75*a* and a second projection end 75*b*. When a pivotal secondary target 68 is in functional condition, the lower and upper retainer portion 78, 80 of the secondary target holding frame 73 each house respectively one of the first and second projection ends 75*a*, 75*b*.

In use, when the projection 72 is received within the passage 76 defined by the retainer portion 74, the secondary target 68 is capable of pivotal displacements between a first hit position (FIGS. 11 and 12) and a second hit position (not shown). The second hit position of any of the secondary targets 68 is normally 180 degrees (about a pivot axis) from the first hit position. In the example shown in FIGS. 11 and 12 for the uppermost secondary target 68, the second hit position is on the opposite side of the head of the target body 14. As for the other secondary targets below secondary target 68 (not numbered but shown for example in the two holes in the middle of the target body 14 in FIG. 11), they would pivot 180 degrees between the middle position (e.g., first hit position) to a position to one side of the target body 14. The pivoting between the first hit position and the second hit position normally occurs in use when a bullet hits any of the secondary targets.

Figure 13:
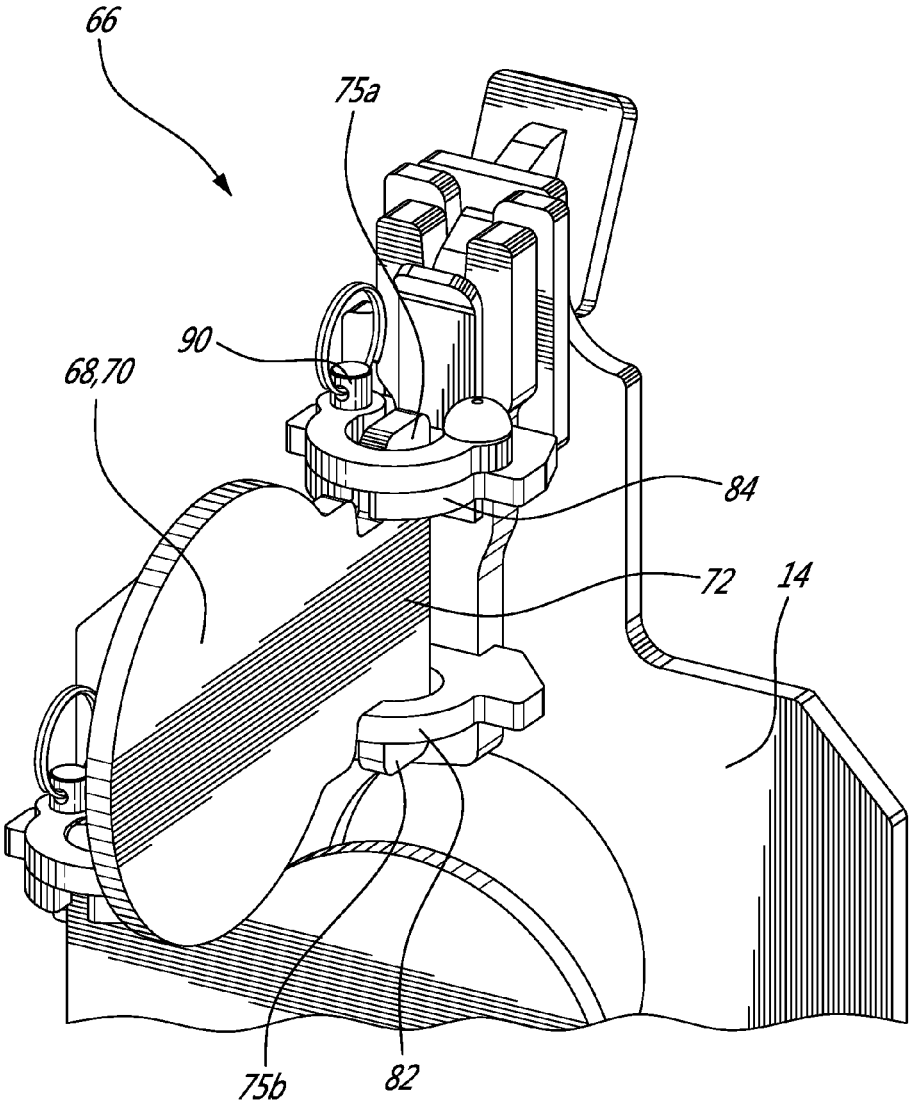
FIG. 13 is another partial close-up view of the secondary target attachment device of FIG. 12.
Figure 14:
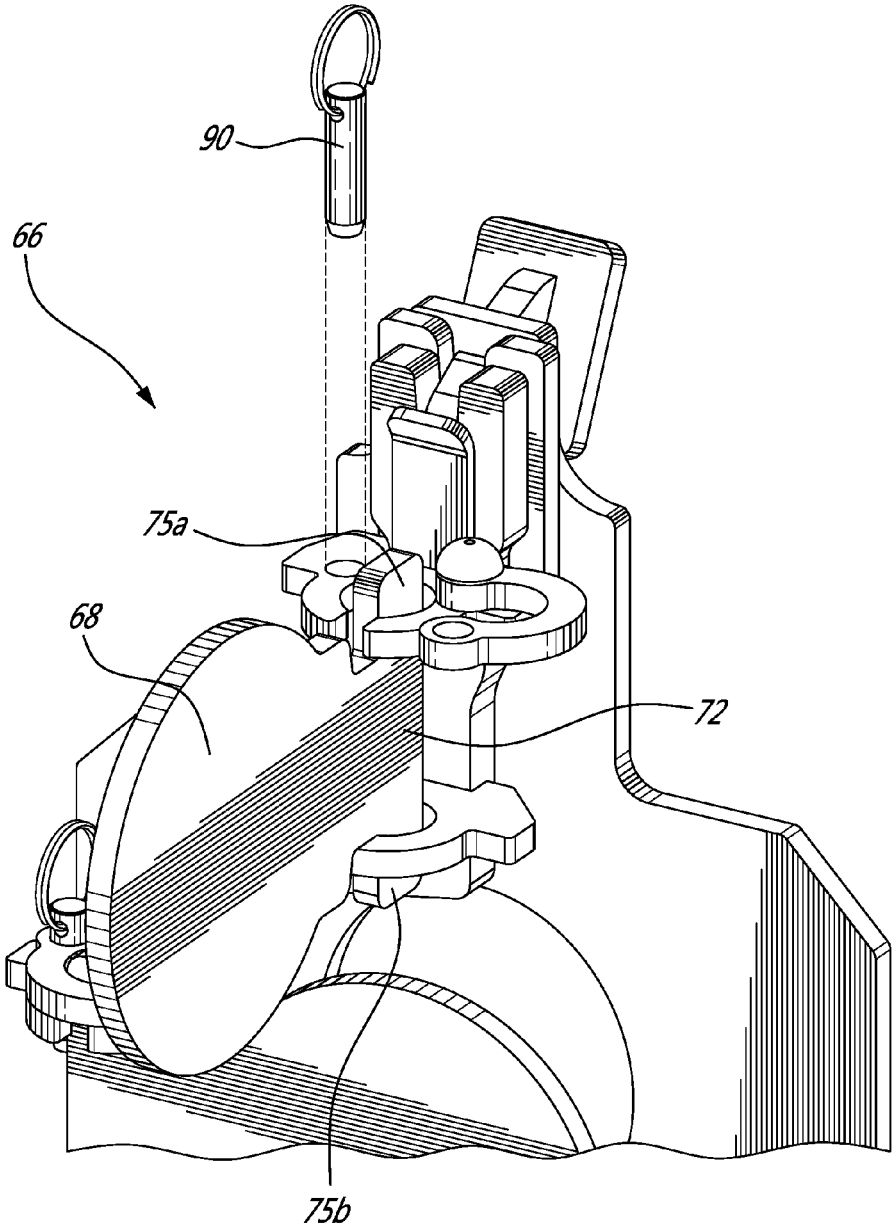
FIG. 14 is another partial close-up view of the secondary target attachment device of FIG. 12.

The secondary targets 68 (or any other secondary target) is installed or removed while in the position shown in FIGS. 13 and 14 where it is locked using a pin 90 after moving the movable part 88 from the open position (FIGS. 14 and 15) to the closed position (FIG. 13).

According to the configuration of the target attachment system 66, the shooter may change from one setup featuring one secondary target 68 to a completely different setup of featuring a plurality of secondary targets 68 without using any tool in less than one minute. Setup changes involve no change in the base 18 used.

Figure 15:
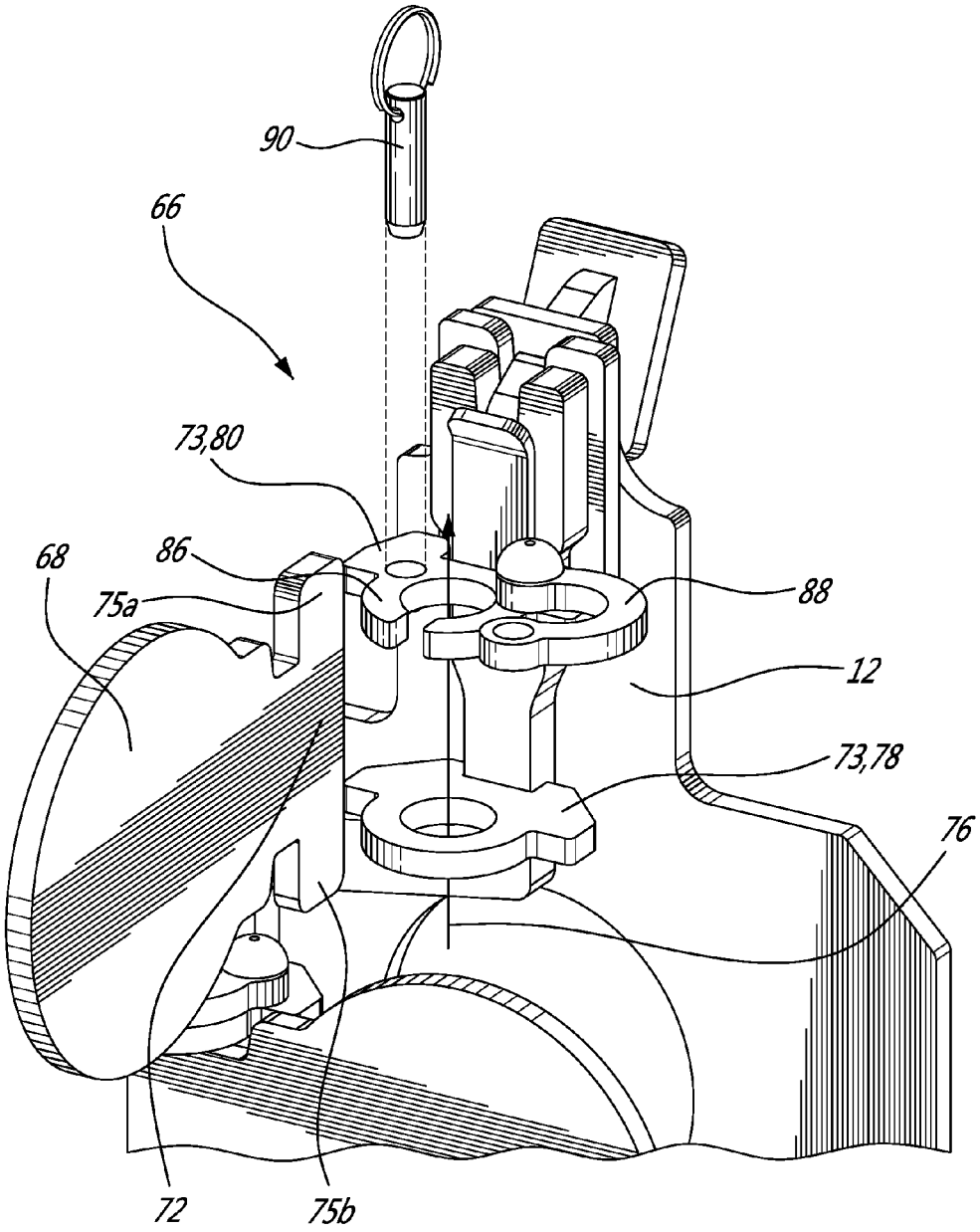
FIG. 15 is another partial close-up view of the secondary target attachment device of FIG. 12.

As better shown in FIG. 15, the secondary target holding frame 73 includes a lower frame 78 and an upper frame 80. Both the lower frame 78 and the upper frame 80 are mounted on the post 20. The upper frame 80 is distant from and in vertical alignment with the lower frame 78. On the other hand, the retainer portion 74 includes a lower retainer portion 82 and an upper retainer portion 84. The lower retainer portion 82 outwardly extends (away from the internal surface 34 of the target body 14) from the lower frame 78, while the upper retainer portion 84 outwardly extends from the upper frame 80. The upper retainer portion 84 is distant from and in vertical alignment with the lower retainer portion 82. Still referring to FIG. 15, there is shown that the lower retainer portion 82 takes the shape of a closed ring-like portion or therefore of a ring-shaped frame. On the other hand, the upper retainer portion 84 includes a fixed part 86 and a movable part 88, which is a pivotal component pivotally mounted on the fixed part 86. The fixed part 86 takes the shape of an opened ring-like portion (or therefore of an open ring-shaped frame) allowing passageway for the projection 72 defined by the secondary target 68 to access the center of the ring-like portion of the upper retainer portion 84, thereby the passage 76 defined by the retainer portion 74. The movable part 88 takes the shape of half a ring-like portion capable to close the passageway of the upper retainer portion 84.

In use, as shown in FIG. 15, the shooter that wishes to attach a secondary target 68 to the target attachment system 66 aligns the projection 72 defined by the secondary target 68 with both the lower retainer portion 82 and the passageway of the fixed part 86 of the upper retainer portion 84. As shown in FIG. 15, the shooter engages the projection 72 within the passage defined by axis 76 by accessing the fixed part 86 of the upper retainer portion 84 (while keeping the lower end of the projection 72 slightly above the lower retainer portion 82). As shown in FIG. 14, the shooter lowers the secondary target 68 (by lowering the projection 72 while keeping alignment between the projection and the passage 76) so that the lower portion of the projection 72 is supported/retained by the lower retainer portion 82. The projection 72 is then held in the passage 76 defined by the retainer portion 74. As shown in FIGS. 12 and 13, the movable part 88 of the upper retainer portion 84 is pivoted thereby closing the passageway of opened ring-like shape of the fixed part 86 of the upper retainer portion 84. The secondary target 68 is then capable of pivoting about an axis 76.

As illustrated, the secondary target holding frame 73 is preferably mounted on the second side 52 of the post 20 (i.e., opposite to the first side 50 of the post 20). Accordingly, with respect to the orientation of the target 12, the secondary target holding frame 73 is mounted on the back face of the support 23, providing the pivotal freedom necessary for the secondary target 68 to pivot in the passage/axis 66.

It is to be mentioned that the target attachment system 66 as described above may feature a plurality of secondary target holding frames 73 and allow a plurality of configurations of the secondary target holding frames 73 for receive a plurality of secondary targets 68 so that the shooter may define different scenarios every time they use the target attachment system 66.

According to the configuration of the target attachment system 66, the secondary targets 68 may be reliable, tougher, easy to setup, more flexible and the like. That above described secondary target holding system, or clamping system or device is easy to use and tough. The target attachment system 66 facilitates the movement of the secondary targets 68, allows a better training with less down time and also facilitates switching from one drill (practice scenario) to another in a matter of seconds.

The target attachment system 66 as described above may lead to a plurality of different shooting arrangements. Indeed, combining the upper post member 56 pivoting relatively to the lower post member 54 and the upper post member 56 being able to completely detaching from the lower post member 54, the target attachment system 10 may be adapted for, or even include an assembly, a plurality of different upper post members 56 that can be used as different target attachment systems 66.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A target attachment system for releasably attaching a target having an opening therethrough, the target attachment system comprising:

a support comprising a holding member and a back abutment surface; and a releasable target attachment element comprising a front face, a back face, an elongated engagement member and an abutment surface;

wherein the elongated engagement member is adapted to be inserted through the target opening and to be releasably fixed to the holding member;

wherein the abutment surface is adapted to abut the target towards the support once the elongated engagement member is releasably fixed to the holding member;

wherein the abutment surface of target attachment element and the back abutment surface are each abutting one of the front face and the back face of the target when the target is attached to the target attachment system; and wherein the back abutment surface defines a front-leaning angle resulting in bullets shot to the target abutting the back abutment surface and ricocheting towards the ground.

2. The target attachment system of claim 1, wherein the releasable target attachment element further comprises a ricochet surface downwardly sloped with respect to the abutment surface, thereby adapted to ricochet bullets toward the ground.

3. The target attachment system of claim 2, wherein the abutment surface has a cross-section greater than the target opening and is adapted to abut the target about the opening.

4. The target attachment system of claim 1, wherein the elongated engagement member has a first end about the abutment surface and a second end adapted to be releasably fixed to the holding member, wherein the elongated engagement member has a curvature between the first end and the second end.

5. The target attachment system of claim 1, wherein the support further comprises a pivotal target holding component comprising a first ring-shaped frame and a second open ring-shaped frame defining a passageway, and a pivotal component adapted to close the passageway once a secondary target is inserted in the first frame and the second frame.

6. The target attachment system of claim 5, wherein the support defines a front face close to the target and a back face opposed to the target, and wherein the pivotal target holding component is mounted on the back face of the support.

7. The target attachment system of claim 1, wherein the elongated attachment member has a defined cross-section shape and the holding member forms a hollow passage of the defined cross-section shape, further wherein the elongated attachment member is for inserting in the hollow passage thereby releasably fixing the releasable target attachment element to the holding member and hence releasably fixing the target to the support.

8. The target attachment system of claim 1, wherein the elongated attachment member comprises an inverted U-shape member and holding member comprises a lip member adapted to receive the inverted U-shaped member and thereby releasably fixing the releasable target element to the holding member and hence releasably fixing the target attachment to the support.

9. A target attachment system for releasably attaching a target having an opening therethrough, the target attachment system comprising:

a support comprising a holding member; and a releasable target attachment element comprising an elongated engagement member and an abutment surface;

wherein the elongated engagement member is adapted to be inserted through the target opening and to be releasably fixed to the holding member; and wherein the abutment surface is adapted to abut the target towards the support once the elongated engagement member is releasably fixed to the holding member;

wherein the support comprises a base, a lower post member and an upper post member comprising a holding member; and wherein the base, the lower post member and the upper post member combine together as a foldable structure.

10. The target attachment system of claim 9, wherein the releasable target attachment element further comprises a ricochet surface downwardly sloped with respect to the abutment surface, thereby adapted to ricochet bullets toward the ground.

11. The target attachment system of claim 9, wherein the support comprises a back abutment surface, and the target has a front face and a back face, with the abutment surface of target attachment element and the back abutment surface each abutting one of the front face and the back face of the target when the target is attached to the target attachment system.

12. The target attachment system of claim 9, wherein the elongated attachment member has a defined cross-section shape and the holding member forms a hollow passage of the defined cross-section shape, further wherein the elongated attachment member is for inserting in the hollow passage thereby releasably fixing the releasable target element to the holding member and hence releasably fixing the target to the support.

13. A target attachment system for releasably attaching a target having an opening therethrough, the target attachment system comprising:

a support comprising a holding member; and a releasable target attachment element comprising an elongated engagement member and an abutment surface;

wherein the elongated engagement member is adapted to be inserted through the target opening and to be releasably fixed to the holding member; and wherein the abutment surface is adapted to abut the target towards the support once the elongated engagement member is releasably fixed to the holding member;

wherein the elongated attachment member has a defined cross-section shape and the holding member forms a hollow passage of the defined cross-section shape;

further wherein the elongated attachment member is for inserting in the hollow passage thereby releasably fixing the releasable target attachment element to the holding member and hence releasably fixing the target to the support;

wherein an upper post member comprises two elongated and parallel projections and the holding member comprises first and second retaining members;

wherein the hollow passage is defined by the two elongated and parallel projections and the first and second retaining members; and where the two elongated and parallel projections define two interior surfaces of the hollow passage while the first and second retaining members define two other interior surfaces of the hollow passage.

14. The target attachment system of claim 13, wherein the support comprises a back abutment surface, and the target has a front face and a back face, with the abutment surface of target attachment element and the back abutment surface each abutting one of the front face and the back face of the target when the target is attached to the target attachment system.

15. The target attachment system of claim 13, wherein the releasable target attachment element further comprises a ricochet surface downwardly sloped with respect to the abutment surface, thereby adapted to ricochet bullets toward the ground.

16. The target attachment system of claim 15, wherein the abutment surface has a cross-section greater than the target opening and is adapted to abut the target about the opening.

17. The target attachment system of claim 13, wherein the elongated engagement member has a first end about the abutment surface and a second end adapted to be releasably fixed to the holding member, wherein the elongated engagement member has a curvature between the first end and the second end.

18. The target attachment system of claim 13, wherein the support further comprises a pivotal target holding component comprising a first ring-shaped frame and a second open ring-shaped frame defining a passageway, and a pivotal component adapted to close the passageway once a secondary target is inserted in the first frame and the second frame.

19. The target attachment system of claim 18, wherein the support defines a front face close to the target and a back face opposed to the target, and wherein the pivotal target holding component is mounted on the back face of the support.

20. The target attachment system of claim 13, wherein the elongated attachment member comprises an inverted U-shape member and the holding member comprises a lip member adapted to receive the inverted U-shaped member and thereby releasably fixing the releasable target element to the holding member and hence releasably fixing the target to the support.

* * * * *